US011994137B2

(12) United States Patent
Miwata et al.

(10) Patent No.: US 11,994,137 B2
(45) Date of Patent: May 28, 2024

(54) VACUUM PUMP

(71) Applicant: Edwards Japan Limited, Chiba (JP)

(72) Inventors: Tooru Miwata, Chiba (JP); Yoshiyuki Takai, Chiba (JP)

(73) Assignee: Edwards Japan Limited, Chiba (JP)

( * ) Notice: Subject to any disclaimer, the term of this patent is extended or adjusted under 35 U.S.C. 154(b) by 0 days.

(21) Appl. No.: 17/762,992

(22) PCT Filed: Sep. 18, 2020

(86) PCT No.: PCT/JP2020/035600

§ 371 (c)(1),
(2) Date: Mar. 23, 2022

(87) PCT Pub. No.: WO2021/065584

PCT Pub. Date: Apr. 8, 2021

(65) Prior Publication Data

US 2022/0412369 A1 Dec. 29, 2022

(30) Foreign Application Priority Data

Sep. 30, 2019 (JP) ..... 2019-179931
Sep. 14, 2020 (JP) ..... 2020-153767

(51) Int. Cl.
*F04D 19/04* (2006.01)
*F04D 29/053* (2006.01)
(Continued)

(52) U.S. Cl.
CPC ..... *F04D 19/042* (2013.01); *F04D 29/053* (2013.01); *F04D 29/102* (2013.01); *F04D 29/584* (2013.01)

(58) Field of Classification Search
CPC ..... F04D 19/042; F04D 19/044; F04D 29/102
See application file for complete search history.

(56) References Cited

U.S. PATENT DOCUMENTS

2015/0184666 A1* 7/2015 Tsubokawa ..... F04D 19/044 415/199.5
2016/0025096 A1 1/2016 Shi et al.
2018/0335052 A1* 11/2018 Sakaguchi ..... F04D 19/042

FOREIGN PATENT DOCUMENTS

EP 3779202 A1 2/2021
JP S5968196 5/1984
(Continued)

OTHER PUBLICATIONS

PCT International Search Report dated Dec. 8, 2020 for corresponding PCT application Serial No. PCT/JP2020/035600, 3 pages.
(Continued)

*Primary Examiner* — Kenneth J Hansen
(74) *Attorney, Agent, or Firm* — Theodore M. Magee; Westman, Champlin & Koehler, P.A.

(57) ABSTRACT

A vacuum pump which suppresses occurrence of deposition caused by an exhaust gas is obtained. The vacuum pump includes: a pump portion including a shaft portion, a rotor disposed on an outer peripheral side of the shaft portion, and a stator disposed on the outer peripheral side of the rotor; a channel of the exhaust gas from the pump portion to an outlet port; and a shielding portion which suppresses contact of the exhaust gas with the shaft portion in the channel. Further, an end portion of the shielding portion has a surface opposed to the rotor.

5 Claims, 4 Drawing Sheets

(51) Int. Cl.
*F04D 29/10* (2006.01)
*F04D 29/58* (2006.01)

(56) References Cited

FOREIGN PATENT DOCUMENTS

| | | | |
|---|---|---|---|
| JP | H09310696 | A | 12/1997 |
| JP | H10306789 | A | 11/1998 |
| JP | H11336691 | A | 12/1999 |
| JP | 2000131476 | A | 5/2000 |
| JP | 2014062480 | A | 4/2014 |
| JP | 2015143513 | A | 8/2015 |
| JP | 2017002856 | A | 1/2017 |
| WO | 2014050648 | A1 | 4/2014 |
| WO | 2018164013 | A1 | 9/2018 |

OTHER PUBLICATIONS

PCT International Written Opinion dated Dec. 8, 2020 for corresponding PCT application Serial No. PCT/JP2020/035600, 4 pages.
European Communication dated Sep. 19, 2023 for European application Serial No. 20872037.5, 8 pages.

* cited by examiner

VACUUM PUMP

CROSS-REFERENCE OF RELATED APPLICATION

This application is a Section 371 National Stage Application of International Application No. PCT/JP2020/035600, filed Sep. 18, 2020, which is incorporated by reference in its entirety and published as WO 2021/065584A1 on Apr. 8, 2021 and which claims priority of Japanese Application No. 2019-179931, filed Sep. 30, 2019 and Japanese Application No. 2020-153767, filed Sep. 14, 2020.

BACKGROUND

The present invention relates to a vacuum pump.

In a turbo-molecular pump, a protection member is replaceably provided on an exhaust pipe which exhausts a gas from a pump portion, whereby deposition of a reaction product on a gas-contact surface (wall surface) to which the deposition can easily adhere is suppressed (see Japanese Patent Application Publication No. 2017-2856). This protection member is fixed to a base through an insulating material, and a temperature thereof becomes high due to radiation from a rotor cylinder portion or a stator as compared with direct fixation to the base.

The discussion above is merely provided for general background information and is not intended to be used as an aid in determining the scope of the claimed subject matter. The claimed subject matter is not limited to implementations that solve any or all disadvantages noted in the background.

SUMMARY

The aforementioned protection member in the turbo-molecular pump has a shape following the shape of the base wall surface, but since an upper end thereof is separated from an opposed rotor, an exhaust gas enters spaces between the rotor and a shaft-portion stator and between the protection member and the shaft-portion stator through a gap between the protection member and the rotor, and there is a possibility that the exhaust gas contacts a portion at a relatively low temperature (a wall surface of the shaft-portion stator extending from a head or the like), due to which there is a possibility that a component of the exhaust gas is deposited and the deposition occurs on the portion.

The present invention was made in view of the aforementioned problem and has an object to obtain a vacuum pump which suppresses occurrence of deposition caused by the exhaust gas.

The vacuum pump according to the present invention includes: a pump portion including a shaft portion, a rotor disposed on an outer peripheral side of the shaft portion, and a stator disposed on the outer peripheral side of the rotor; a channel of an exhaust gas from the pump portion to an outlet port; and a shielding portion which suppresses contact of the exhaust gas with the shaft portion in the channel. Further, an end portion of the shielding portion has a surface opposed to the rotor.

According to the present invention, a vacuum pump which suppresses occurrence of deposition caused by an exhaust gas can be obtained.

The aforementioned or other objects, characteristics and superiorities of the present invention will be made more apparent from the detailed description below together with the attached figures.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DETAILED DESCRIPTION

Hereinafter, embodiments of the present invention will be described on the basis of the figures.

Embodiment 1

Figure 1:
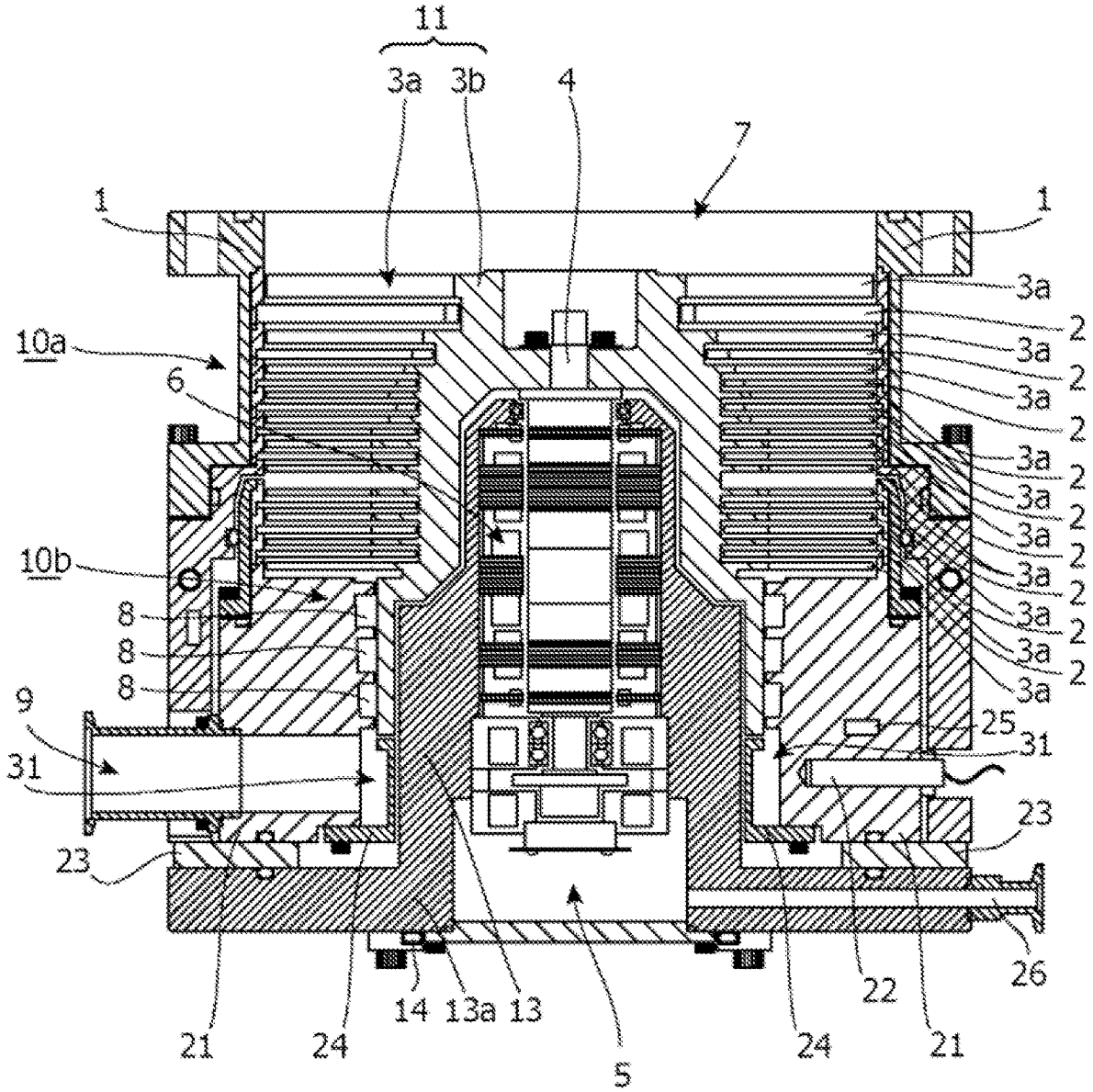
FIG. 1 is a diagram illustrating an internal configuration of a vacuum pump according to an embodiment 1 of the present invention.

FIG. 1 is a diagram illustrating an internal configuration of a vacuum pump according to an embodiment 1 of the present invention. The vacuum pump shown in FIG. 1 includes a turbo-molecular pump portion 10*a* and a thread-groove pump portion 10*b* on a rear stage thereof and includes a casing 1, a stator blade 2, a rotor blade 3*a*, a rotor inner cylinder portion 3*b*, a rotor shaft 4, a bearing portion 5, a motor portion 6, an inlet port 7, a thread groove 8, and an outlet port 9. A rotor 11 is constituted by the rotor blade 3*a* and the rotor inner cylinder portion 3*b*, and the rotor 11 is connected to the rotor shaft 4 by screwing or the like and fixed.

The casing 1 has a substantially cylindrical shape and accommodates the rotor 11, the bearing portion 5, the motor portion 6 and the like in an internal space thereof, and a plurality of stages of the stator blades 2 are fixed to an inner peripheral surface thereof. The stator blade 2 is disposed at a predetermined elevation angle. The casing 1 and the stator blade 2 constitute the stator of the turbo-molecular pump portion 10*a*.

In the casing 1, the plurality of stages of rotor blades 3*a* and the plurality of stages of stator blades 2 are disposed alternately in a height direction of the rotor shaft (rotor-shaft direction). Each of the rotor blades 3*a* extends from the rotor inner cylinder portion 3*b* and has a predetermined elevation angle.

The bearing portion 5 is a bearing of the rotor shaft 4 and is a magnetic-floating type bearing, for example, and includes a sensor which detects deviation of the rotor shaft 4 in an axial direction and a radial direction and an electromagnet or the like which suppresses the deviation of the rotor shaft 4 in the axial direction and the radial direction. Note that the bearing type of the bearing portion 5 is not limited to the magnetic floating type. The motor portion 6 rotates the rotor shaft 4 by an electromagnetic force.

The bearing portion 5 and the motor portion 6 are disposed in a hollow part in a shaft portion 13 (stator column) In this embodiment, the shaft portion 13 is integral with a base portion 13*a*, a cooling pipe 14 is provided in the base portion 13*a*, and a refrigerant such as water is made to flow through the cooling pipe 14. For example, the shaft portion 13 (and the base portion 13*a*) is an aluminum material with good heat conductivity. As a result, the base portion 13*a* and thus, the shaft portion 13 are cooled, and electric components such as the motor portion 6 are operated soundly.

The inlet port 7 is an upper-end opening part of the casing 1, has a flange shape, and is connected to a chamber or the like, not shown. To the inlet port 7, gas molecules fly from the chamber or the like due to a thermal motion or the like. The outlet port 9 has a flange shape and exhausts gas molecules and the like sent from the rotor blade 3*a* and the stator blade 2.

Note that the vacuum pump shown in FIG. 1 is a composite blade type including the thread-groove pump portion 10*b* by a thread groove 8 on a rear stage of the turbo-molecular pump portion 10*a* by the aforementioned stator blade 2 and rotor blade 3*a*. The vacuum pump may be of a full-blade type.

As shown in FIG. 1, this thread-groove pump portion 10*b* includes the shaft portion 13, the rotor 11 disposed on the outer peripheral side of the shaft portion 13, and the stator 21 disposed on an outer periphery of the rotor 11.

In the vacuum pump shown in FIG. 1, a channel of a gas to be exhausted (exhaust gas) is from the inlet port 7 to the outlet port 9 and includes the inlet port 7, a space between the rotor 11 and the stator (the stator blade 2 and the casing 1) of the turbo-molecular pump portion 10*a*, a space between the stator 21 (specifically, the thread groove 8) and the rotor 11 (specifically, the rotor inner cylinder portion 3*b*) of the thread-groove pump portion 10*b*, and the outlet port 9.

A heater 22 is provided on the stator 21 of the thread-groove pump portion 10*b*, and the stator 21 is heated by the heater 22. Note that an insulating member 23 is provided between the stator 21 and the base portion 13*a* in a contact-sealed state between the both. As a result, a temperature on the outer peripheral side of the channel from an exit of the thread-groove pump portion 10*b* on the last stage to the outlet port 9 is raised, and occurrence of deposition caused by the exhaust gas is suppressed.

Moreover, in this embodiment, a shielding portion 24 is connected to the stator 21. The shielding portion 24 is a substantially annular member and has a sectional shape as shown in FIG. 1, for example. The shielding portion 24 is provided in order to suppress contact of the exhaust gas with the shaft portion 13 in a channel 31 of the exhaust gas from the thread-groove pump portion 10*b* on the last stage to the outlet port 9.

Figure 2:
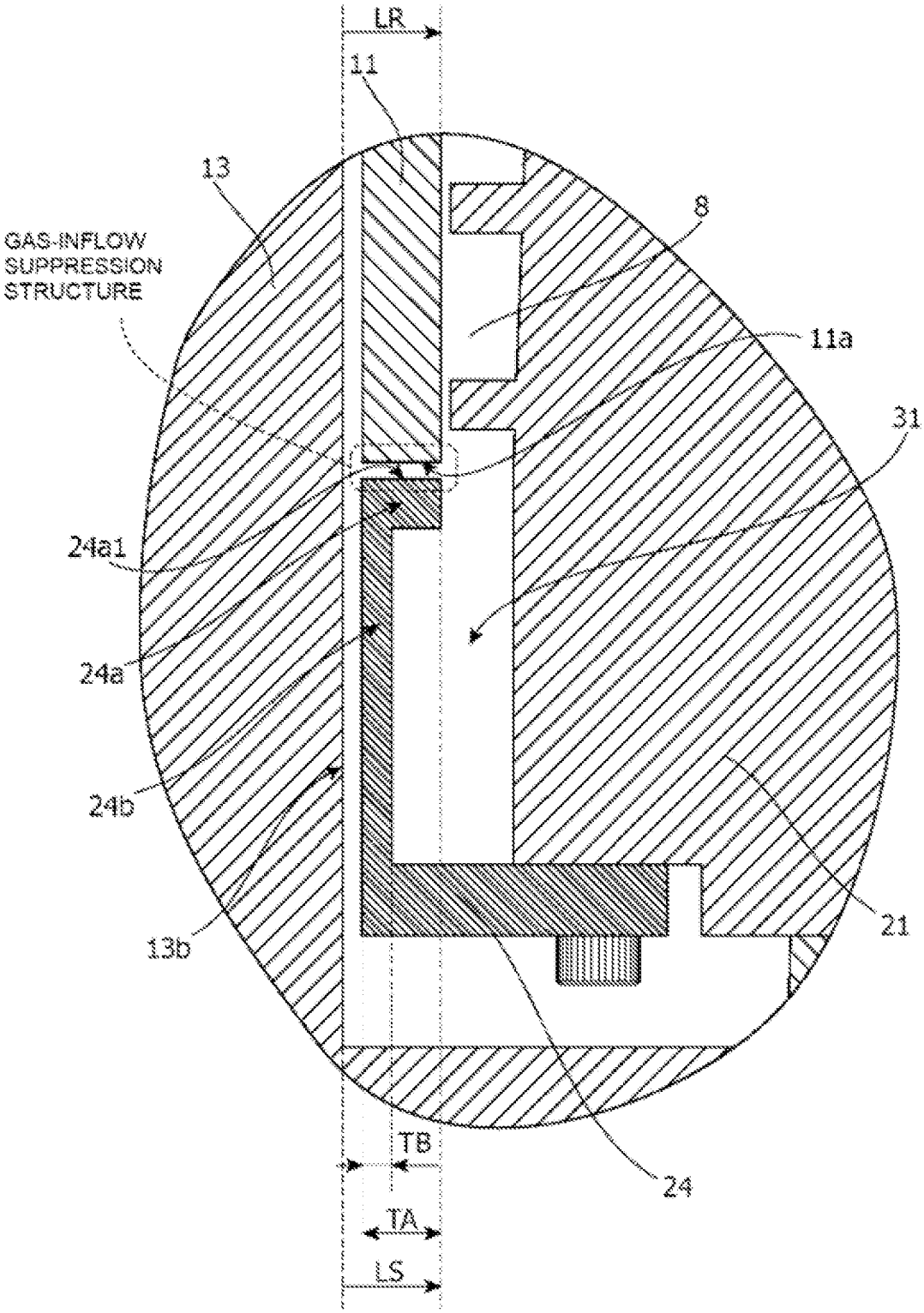
FIG. 2 is a diagram for explaining details of a shape of a shielding portion in FIG. 1.

FIG. 2 is a diagram for explaining details of the shape of the shielding portion 24 in FIG. 1.

As shown in FIG. 2, for example, the shielding portion 24 is constituted such that an end portion 24*a* thereof has a surface 24*a*1 opposed to the rotor 11 and has a gas-inflow suppression structure by the surface 24*a*1 and the rotor 11. In this embodiment, the gas-inflow suppression structure is formed by setting a clearance between the end portion 24*a* (the aforementioned surface 24*a*1 opposed to the rotor 11) of the shielding portion 24 and the rotor 11 (a bottom surface 11*a* opposed to the end portion 24*a*) a micro width. The clearance width (that is, a distance between the surface 24*a*1 and the rotor 11) is approximately 1 to 1.5 mm, for example. The clearance width may be substantially equal to or less than a distance from the wall surface 13*b* of the shaft portion 13 to the inner peripheral surface of the shielding portion 24. Moreover, the gas-inflow suppression structure may be a non-contact seal structure, for example.

Moreover, in this embodiment, the shielding portion 24 includes an intermediate portion 24*b* extending to the end portion 24*a* along the wall surface 13*b* of the shaft portion 13 (upward in the vertical direction, here) and is formed so that a thickness TB of the intermediate portion 24*b* is smaller than a thickness TA of the end portion 24*a*. As a result, heat conduction from the stator 21 to the rotor 11 through the shielding portion 24 is suppressed, and a channel area of the channel 31 becomes larger.

Furthermore, the shielding portion 24 is constituted and disposed so that a distance LS from the wall surface 13*b* of the shaft portion 13 to an outer peripheral surface of the end portion 24*a* of the shielding portion 24 is substantially equal to or shorter than a distance LR from the wall surface 13*b* of the shaft portion 13 to the outer peripheral surface of the rotor 11 (a part in the thread-groove pump portion 10*b*). As a result, the channel close to the exit of the thread-groove pump portion 10*b* is not interfered by the end portion 24*a* of the shielding portion 24.

Here, an interval between the shaft portion 13 and the shielding portion 24 and an interval between the shaft portion 13 and the rotor 11 may be substantially the same. Moreover, the interval between the shaft portion 13 and the shielding portion 24 and an interval between the end portion 24*a* of the shielding portion 24 and the rotor 11 may be substantially the same as each other. As a result, the aforementioned gas-inflow suppression structure is reinforced.

Here, the stator 21 is a heating member including the heater 22, is an aluminum material, for example, and is opposed to the channel 31. In the embodiment 1, the shielding portion 24 is formed as a single member and is fixed to this stator 21 as the heating member by screwing, for example, so as to be directly joined (without an insulating material) thereto. Note that the shielding portion 24 may be realized by shaping a part of this stator 21 as the heating member (that is, in that case, the shielding portion 24 is a part of the heating member). By constituting as above, since a heat is conducted from the stator 21 to the shielding portion 24, a temperature of the shielding portion 24 is controlled higher than the shaft portion 13.

Note that temperature control of the stator 21 and the like is conducted by using a temperature sensor 25 provided on the stator 21.

For example, a width of the clearance between the end portion 24*a* of the shielding portion 24 and the rotor 11 is set to approximately 1.5 mm, TA=approximately 4 mm, and LR=approximately 8 mm.

Subsequently, an operation of the vacuum pump according to the embodiment 1 will be described.

When a chamber or the like is connected to the inlet port 7 of the vacuum pump, and the motor portion 6 is operated in accordance with an instruction from a control device, not shown, the rotor shaft 4 is rotated, and the rotor 11 is also rotated. As a result, in the turbo-molecular pump portion 10*a*, the gas molecules having flown through the inlet port 7 is advanced to the channel by the rotor blade 3*a* and the stator blade 2, and the gas molecules are exhausted as an exhaust gas to the channel 31, pass through the channel 31 and are exhausted from the outlet port 9 by the rotor 11 and the stator 21 in the thread-groove pump portion 10*b* on the rear stage.

Moreover, a temperature of the shielding portion 24 becomes higher than that of the shaft portion 13 by supply of a heat from the stator 21 as the heating member, whereby occurrence of deposition in the shielding portion 24 is suppressed. For example, the stator 21 is temperature-controlled higher than approximately 100 degrees centigrade, and the base portion 13*a* is temperature-controlled lower than approximately 60 degrees centigrade.

As described above, according to the aforementioned embodiment 1, the thread-groove pump portion 10*b* includes the shaft portion 13, the rotor 11 disposed on the outer peripheral side of the shaft portion 13, and the stator 21 disposed on the outer peripheral side of the rotor 11. The shielding portion 24 suppresses contact of the exhaust gas with the shaft portion 13 in the channel of the exhaust gas from the pump portion 10*b* thereof to the outlet port 9. And the end portion 24*a* of the shielding portion 24 has the surface 24*a*1 opposed to the rotor 11.

As a result, advance of the exhaust gas is restricted by the shielding portion 24, and it becomes hard for the exhaust gas to contact the wall surface of the shaft portion 13 or the upper surface of the base portion 13*b* at a relatively low temperature and thus, occurrence of deposition caused by the exhaust gas is suppressed.

Embodiment 2

Figure 3:
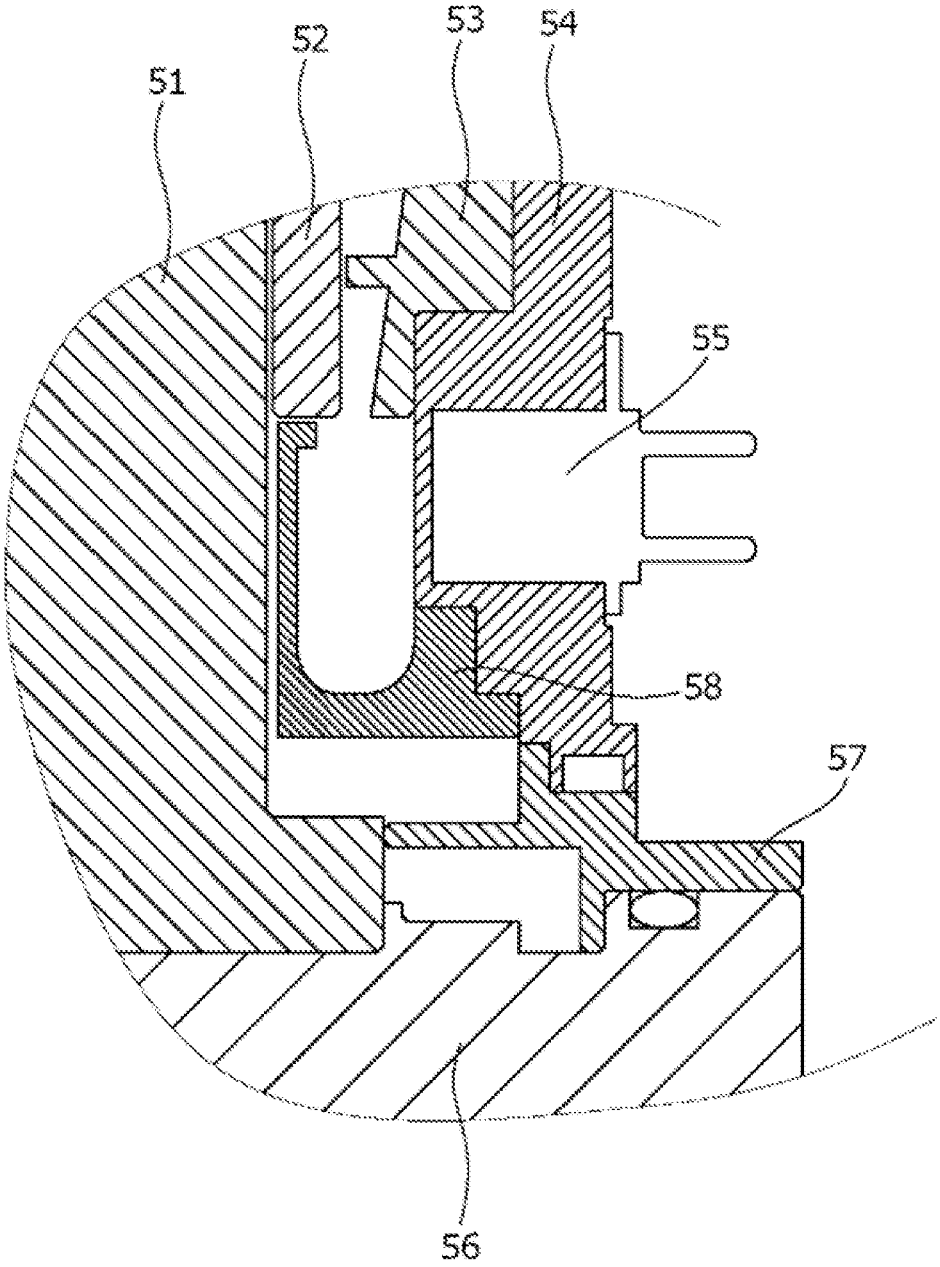
FIG. 3 is a diagram for explaining details of the shielding portion in a vacuum pump according to an embodiment 2 of the present invention.

FIG. 3 is a diagram for explaining details of a shielding portion in a vacuum pump according to an embodiment 2 of the present invention.

In the vacuum pump shown in FIG. 3, similarly to the embodiment 1, a rotor 52 is provided on an outer peripheral side of a shaft portion 51, and a stator 53 of a thread-groove pump portion is provided on the outer peripheral side of the rotor 52. Moreover, a spacer 54 joined to the stator 53 is provided, and a heater 55 is provided on the spacer 54. The shaft portion 51 is joined to a head portion 56, and similarly to the embodiment 1, when the head portion 56 is cooled, the shaft portion 51 is also cooled. Between the spacer 54 as a heating member and the head portion 56, an insulating member 57 is provided. Here, since the spacer 54 is provided as a separate member from the stator 53, the spacer 54 may be made of a stainless material, for example, in order to ensure strength at a high temperature.

And in the embodiment 2, a shielding portion 58 is fixed to the spacer 54 as shown in FIG. 3, for example. The shielding portion 58 also has a substantially annular shape.

In the embodiment 2, the shielding portion 58 is constituted such that an end portion thereof has a gas-inflow suppression structure between it and the rotor 52. In this embodiment, by setting a clearance between the end portion of the shielding portion 58 and the rotor 52 to a micro width, the gas-inflow suppression structure is formed.

Moreover, the shielding portion 58 includes an intermediate portion extending to the end portion of the shielding portion 58 along a wall surface of the shaft portion 51 and is formed so that a thickness of the intermediate portion is smaller than a thickness of the end portion.

Furthermore, the shielding portion 58 is constituted and disposed such that a distance from the wall surface of the shaft portion 51 to an outer peripheral surface of the end portion of the shielding portion 58 is substantially equal to or shorter than a distance from the wall surface of the shaft portion 51 to the outer peripheral surface of the rotor 52 (a part in the thread-groove pump portion).

Note that, since the other constitutions and operations of the vacuum pump according to the embodiment 2 are similar to those of the embodiment 1, explanation thereof is omitted.

Embodiment 3

Figure 4:
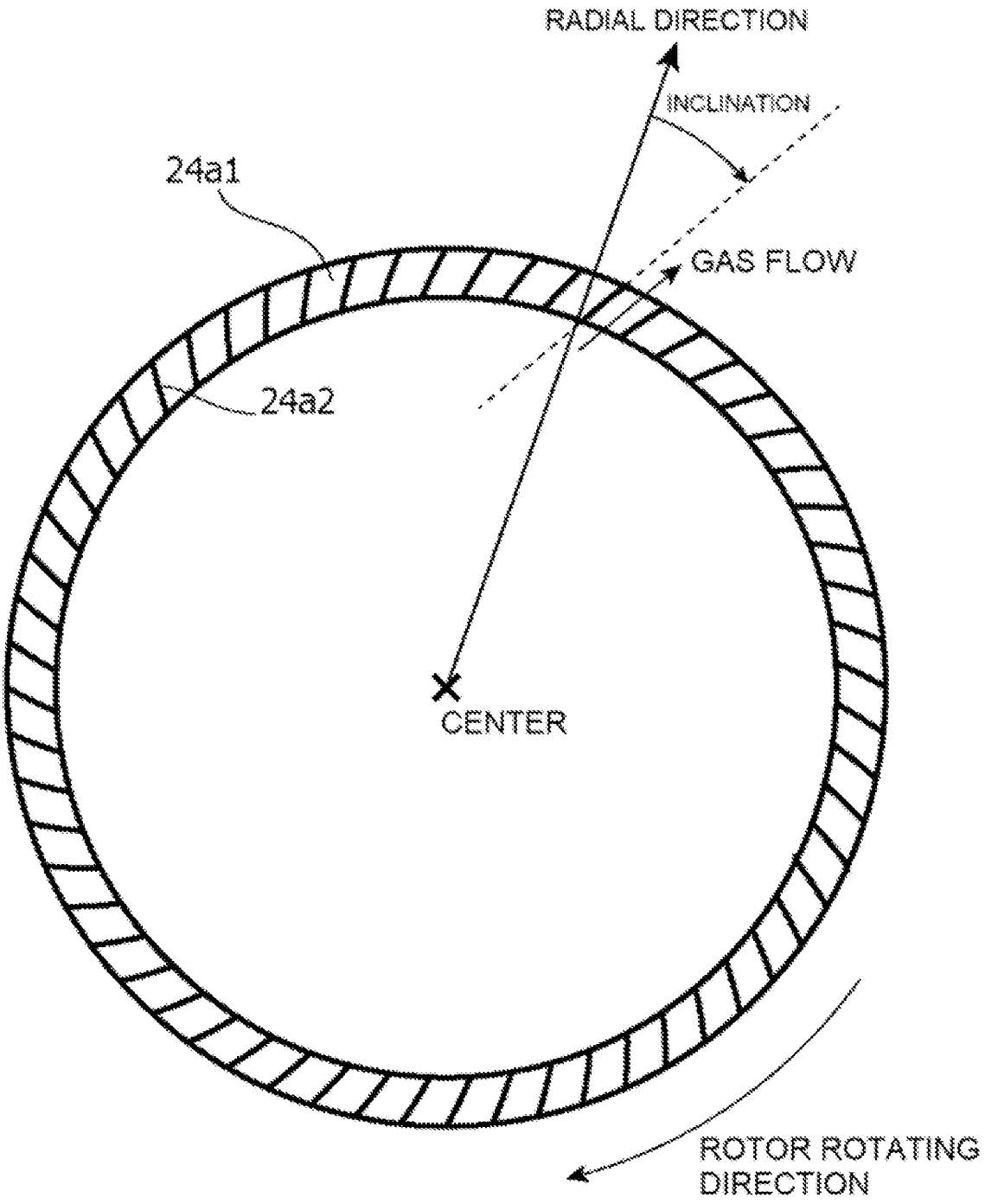
FIG. 4 is a top view illustrating an example of a groove structure provided on a surface of the shielding portion in a vacuum pump according to an embodiment 3.

FIG. 4 is a top view illustrating an example of a groove structure 24*a*2 provided on the surface 24*a*1 of the shielding portion 24 in the vacuum pump according to an embodiment 3.

The groove structure 24*a*2 shown in FIG. 4 has a shape which suppresses inflow of the exhaust gas to the shaft portions 13 and 51 sides through clearances between the shielding portion 24 (surface 24*a*1) and the rotors 11 and 52 (bottom surface 11*a*). The groove structure 24*a*2 includes a plurality of grooves inclined with respect to a radial direction as shown in FIG. 4, for example, and wall surfaces (plane or curved surface) of the plurality of grooves are inclined with an angle and a direction according to rotating directions of the rotors 11 and 52 so that the exhaust gas (gas molecules and the like) having entered the grooves is exhausted to outsides of the rotors 11 and 52 sides by relative rotation of the shielding portion 24 and the rotors 11 and 52.

Note that a sectional shape of each groove in the groove structure 24*a*2 is substantially rectangular, substantially triangular or the like, for example, and is not particularly limited.

Moreover, the shape of each groove in the groove structure 24*a*2 may be linear or spiral.

Since the other constitutions and operations of the vacuum pump according to the embodiment 3 are similar to those of the embodiment 1 or the embodiment 2, explanation thereof is omitted.

The various changes and modifications to the aforementioned embodiments are apparent to those skilled in the art. Such changes and modifications may be performed without departing from the gist and the range of subjects thereof and without weakening intended advantages. That is, it is intended that such changes and modifications are included in claims.

For example, in the aforementioned embodiment 3, the groove structure 24*a*2 is provided on the surface 24*a*1 of the shielding portion 24, but a similar groove structure may be provided on the bottom surface 11*a* of the rotor 11 or may be provided on both the surface 24*a*1 and the bottom surface 11*a*. Alternatively, the groove structure 24*a*2 may be provided not on the entire region of the surface 24*a*1 of the shielding portion 24 but only on a part on the outer peripheral side, for example.

Moreover, for example, in the aforementioned embodiment 3, it may be so configured that a purge gas is introduced from a purge-gas port 26 and conducted through a clearance between the rotor 11 and the shaft portion 13, and the purge gas is exhausted through the clearance between the shielding portion 24 (surface 24*a*1) and the rotors 11 and 52 (bottom surface 11*a*). In that case, since the purge gas is efficiently exhausted to an exhaust gas channel through the clearance by a drag effect by the groove structure 24*a*2 and the like, the exhaust gas more hardly contacts the wall surface of the shaft portion 13 or the upper surface of the base portion 13*b*.

For example, in the aforementioned embodiments 1 and 2, the aforementioned gas-inflow suppression structure may be a labyrinth-seal structure, for example.

present invention can be applied to a vacuum pump, for example.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump, comprising:

a pump portion including a base, a stationary shaft portion extending from the base, a rotor disposed on an outer peripheral side of the stationary shaft portion, and a stator disposed on the outer peripheral side of the rotor;

a channel of an exhaust gas from the pump portion to an outlet port; and a shielding portion which suppresses contact of the exhaust gas with the stationary shaft portion in the channel, wherein an end portion of the shielding portion has a surface opposed to a surface of the rotor, wherein the surface of the rotor extends radially inward from the outer peripheral side of the rotor; and wherein the base and the stationary shaft portion are thermally insulated from the stator and the shielding portion by an insulating material having first and second contact surfaces between the stator and the base.

2. The vacuum pump according to claim 1, wherein the shielding portion includes an intermediate portion which extends to the end portion along a wall surface of the stationary shaft portion, and a thickness of the intermediate portion is smaller than a thickness of the end portion.

3. The vacuum pump according to claim 1, wherein a distance from a wall surface of the stationary shaft portion to an outer peripheral surface of the end portion of the shielding portion is equal to or smaller than a distance from the wall surface of the stationary shaft portion to the outer peripheral surface of the rotor.

4. The vacuum pump according to claim 1, further comprising a groove structure which suppresses inflow of the exhaust gas to the stationary shaft portion side through a clearance between the shielding portion and the rotor on at least one of a surface of the shielding portion and a surface of the rotor opposed to the surface.

5. The vacuum pump according to claim 1, further comprising a heating member including a heater, wherein the stationary shaft portion is cooled, and the shielding portion is one member fixed to the heating member or a part of the heating member.

* * * * *